US005768905A

United States Patent [19]

Oh

[11] Patent Number: 5,768,905

[45] Date of Patent: Jun. 23, 1998

[54] REFRIGERATOR HAVING A WATER DISPENSER AND A WATER STERILIZER

[75] Inventor: Gil-Soo Oh, Suwon, Rep. of Korea

[73] Assignee: Samsung Electronics Co., Ltd., Suwon, Rep. of Korea

[21] Appl. No.: 749,890

[22] Filed: Nov. 18, 1996

[30] Foreign Application Priority Data

Dec. 19, 1995 [KR] Rep. of Korea ..... 1995-52132
Oct. 21, 1996 [KR] Rep. of Korea ..... 1996-47120

[51] Int. Cl.[6] ..... F25D 23/00; B67D 5/62

[52] U.S. Cl. ..... 62/264; 62/389

[58] Field of Search ..... 62/264, 389, 391, 62/394; 122/146.1, 129

[56] References Cited

U.S. PATENT DOCUMENTS

| | | | |
|---|---|---|---|
| 2,339,085 | 1/1944 | Luckiesh | 62/264 |
| 2,341,872 | 2/1944 | Kasold | 62/389 |
| 2,533,732 | 12/1950 | James | 62/264 |
| 2,586,853 | 2/1952 | Morton | 62/264 |
| 2,622,409 | 12/1952 | Stirnkorb | 62/264 |
| 3,570,266 | 3/1971 | Alvarez et al. | 62/389 |
| 4,255,937 | 3/1981 | Erlich | 62/264 |
| 5,064,097 | 11/1991 | Brog et al. | 222/129 |
| 5,272,888 | 12/1993 | Fisher et al. | 62/344 |
| 5,542,265 | 8/1996 | Rutland | 62/389 |

*Primary Examiner*—William Doerrler
*Attorney, Agent, or Firm*—Burns, Doane, Swecker & Mathis, L.L.P.

[57] ABSTRACT

A refrigerator includes a water storage container disposed in a refrigerating compartment for dispensing drinking water through a door of the refrigerator. The container is open at its upper end, and an ultraviolet lamp is mounted above the container so that ultraviolet light from the lamp enters the container and sterilizes the water disposed therein. The lamp is disposed in a groove formed in the underside of a partition wall which divides the refrigerator interior into the refrigerating compartment and a freezing compartment disposed thereabove.

10 Claims, 5 Drawing Sheets

REFRIGERATOR HAVING A WATER DISPENSER AND A WATER STERILIZER

FIELD OF THE INVENTION

The present invention relates to a refrigerator and more particularly relates to a drinking water supply apparatus of a refrigerator in which sterilization means for emitting ultraviolet rays into a water container is provided in order to prevent the drinking water from being contaminated.

BACKGROUND OF THE INVENTION

An example of a conventional refrigerator having a container for storing drinking water is shown in FIG. 1.

As shown in FIG. 1, the refrigerator includes a refrigerator body 10 provided with a food storing compartment 11. At the front portion of the refrigerator body 10, a door 12 is mounted which serves to open and close the compartment 11.

At a predetermined area of the upper portion of the compartment 11 a container 20 is detachably disposed. At one side of the container 20 a drinking water dispensing apparatus is disposed to dispense the drinking water from the container 20 at a state when the door 12 is closed.

The drinking water dispensing apparatus is disclosed in detail in FIG. 2.

As shown in FIG. 2, the drinking water supply apparatus includes pump 32 for pumping the drinking water from the container 20. The pump 32 is connected with a discharge pipe 33 which is extended to the front of the compartment 1 1.

The door 12 is provided with a storage chamber 35 for storing the drinking water passing through the discharge pipe 33 by the pumping operation of the pump 32 .

Furthermore, the storage 35 is connected with a guide pipe 34 which protrudes to the outside of the door 12.

Therefore, the user dispenses the drinking water from the container 20 while the door 12 is being closed.

Although the conventional refrigerator has the drinking water supply apparatus as the foregoing description it has a problem that there is no sterilization means for sterilizing the drinking water in the container thereby whereby the drinking water cannot be stored in the container for a long time.

That is, it is highly probable that the drinking water in the container may be contaminated due to contamination-causing materials for example, bacillus or foreign materials when the container is not cleaned for a long time.

SUMMARY OF THE INVENTION

Therefore, an object of the invention is to solve the above-mentioned problem and to provide a drinking water supply apparatus of a refrigerator, in which a sterilization unit for emitting ultraviolet rays is provided, thereby preventing drinking water from being contaminated.

In order to achieve the above object the present invention provides a drinking water supply apparatus of a refrigerator comprising:

a container being disposed at a predetermined area at the inside of a refrigerator body for storing drinking water;

a sensing switch for sensing the container's presence; and sterilization means being disposed at a predetermined area of a partition member which vertically divides the interior of the refrigerator into two compartments, for emitting ultraviolet rays into the container.

BRIEF DESCRIPTION OF THE DRAWINGS

Other objects and aspects of the invention will become apparent from the following description of embodiment with reference to the accompanying drawings in which.

DETAILED DESCRIPTION OF A PREFERRED EMBODIMENT OF THE INVENTION

Now, a drinking water dispensing apparatus in accordance with the present invention will be described in detail with reference to the drawings.

Figure 1:
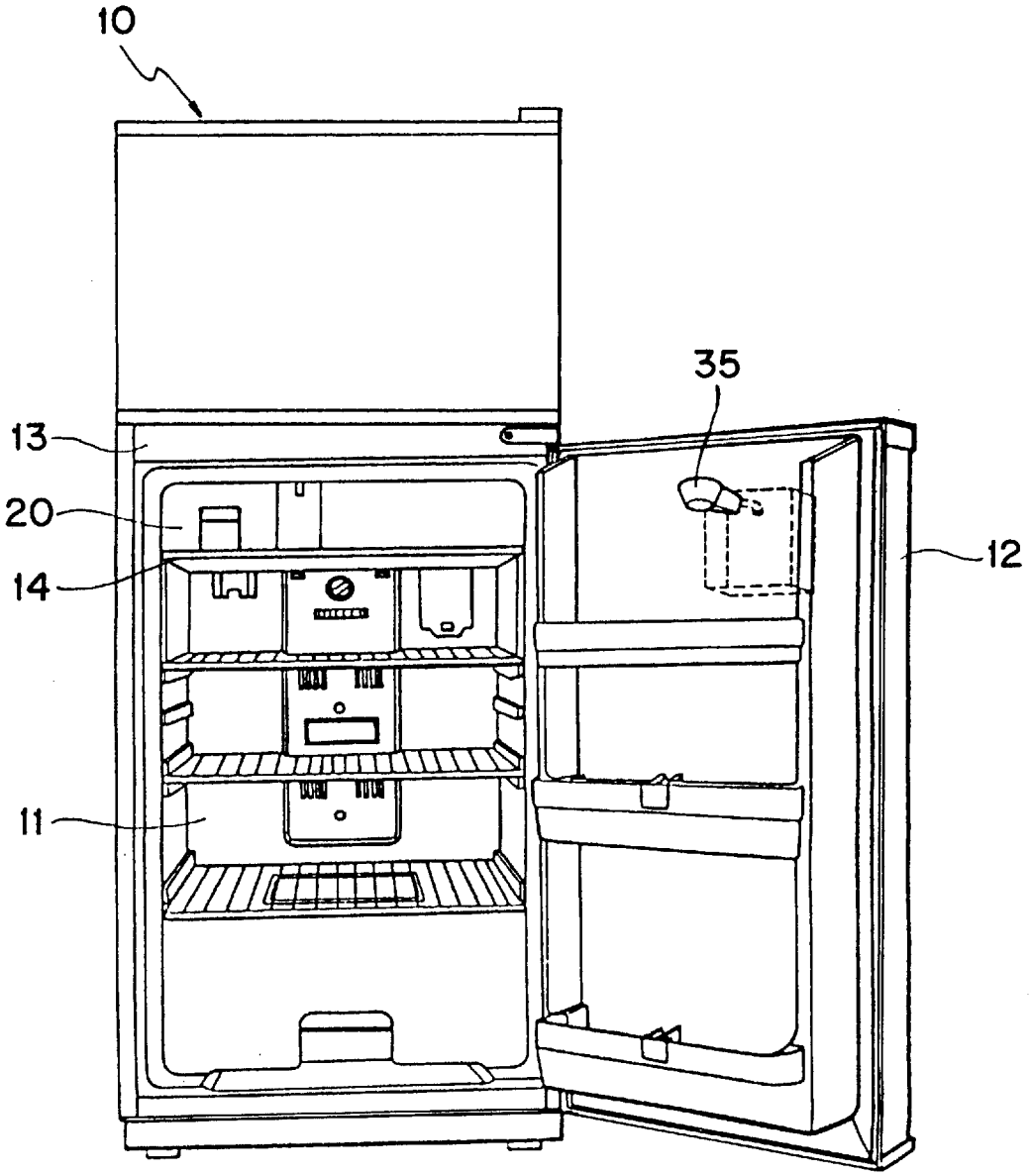
FIG. 1 (PRIOR ART)
FIG. 1 is a schematic view illustrating an internal structure of a conventional refrigerator.
Figure 2:
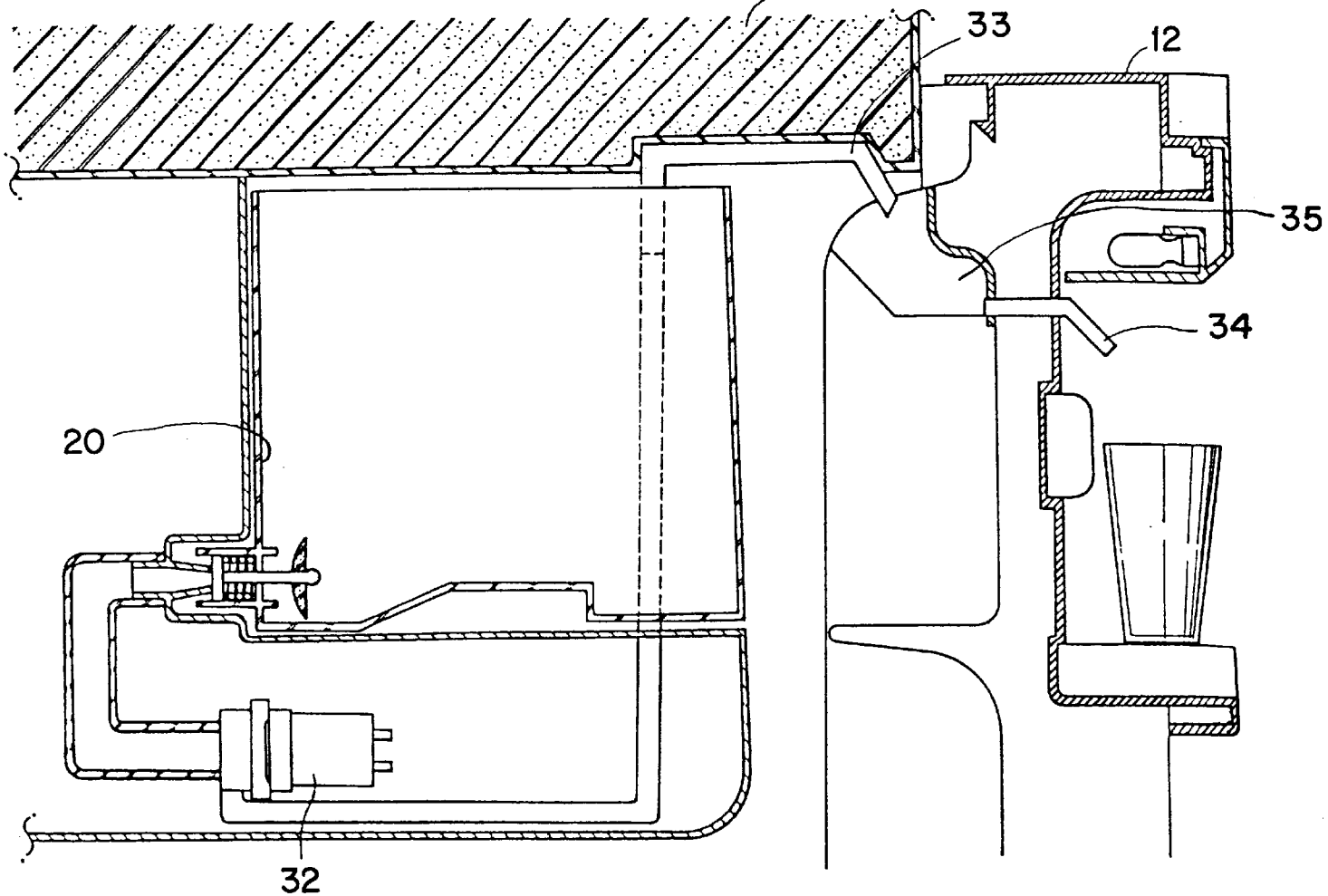
FIG. 2 (PRIOR ART)
FIG. 2 is a sectional view illustrating a drinking water supply apparatus of the conventional refrigerator.
Figure 3:
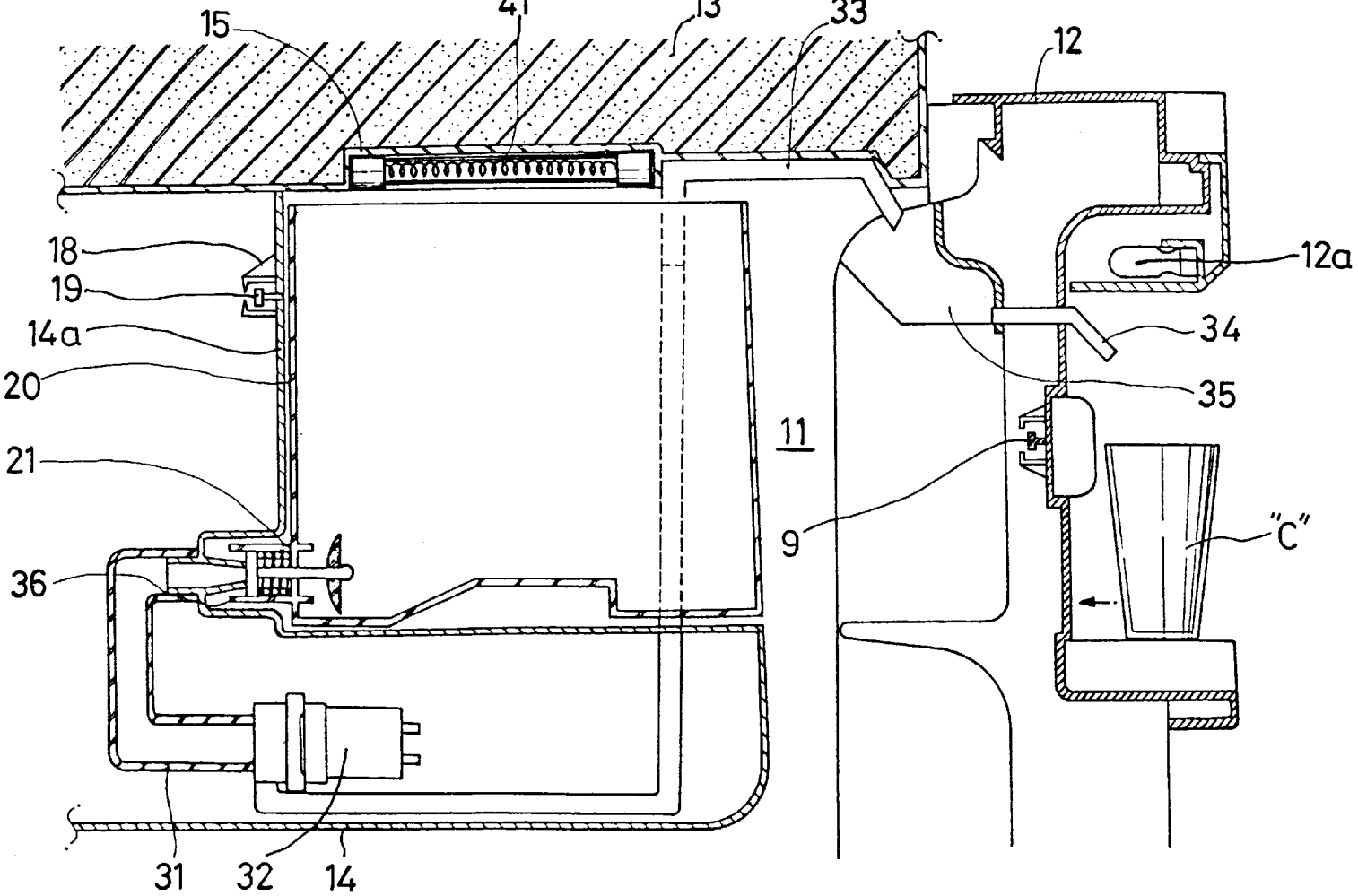
FIG. 3 is a sectional view illustrating a drinking water supply apparatus of the present invention.

The refrigerator provided with the drinking water dispensing apparatus, as shown in FIG. 3, includes the body 10 provided with the food storing compartment 11.

At the front portion of the refrigerator body 10, the door 12 is hinged and which serves to open and close the compartment 11 by a hinge not shown.

The compartment 11 is vertically divided into two compartments by a partition member 13, namely, a freezing compartment and a refrigerating compartment.

At a predetermined area of a rear wall 14*a* a sensing switch 19 is attached for sensing whether or not the container 20 storing the drinking water (hereinafter, it is described as "water") is disposed at a regular or operable position. The sensing switch 19 is disposed at the inside of a case 18 which is attached to a predetermined area of the rear wall 14*a*. The sensing switch 19 is connected to the container 20 for sensing the container's presence.

The compartment 11 is provided with the drinking water dispensing apparatus

Meanwhile, the container 20 has such a shape that the upper side thereof is opened as shown in FIG. 3. Below the container 20 a pump 32 for pumping the water from the container 20 through suction pipes 31 is mounted.

The suction pipes 31 communicate with two discharge ports 21 (only one shown) which are formed at the rear portion of the container 20.

The door 12 is provided at a predetermined area with a lamp 12*a* for indicating the amount of the water in the container 20.

Furthermore, at a lower portion of the lamp 12*a* a guide pipe 34 protrudes to the outside of the door 12. Therefore, the water being pumped by the pump 32 can be discharged to outside of the door 12 through the guide pipe 34 for drinking.

Meanwhile, an outlet side of the pump 32 is connected to another side of the discharge pipe 33, thereby causing the water to be guided to the guide pipe 34. The outlet side of the discharge pipe 33 is designed to be positioned above the inlet side of the guide pipe 34 when the door 12 is closed.

At the inlet side of the dispensing pipe 34, a storage chamber 35 having a predetermined shape is connected thereto.

The storage chamber 35 serves to guide the water from the discharge pipe 33 toward the guide pipe 34.

Meanwhile, the discharge ports 21 are provided with valves 36 therein.

The valves 36 serve to close the discharge ports 21 when the container 20 is removed from the regular or operating position.

The partition member 13 is provided with an ultraviolet lamp 41 for emitting ultraviolet rays into the container 20, thereby preventing the water from being contaminated.

That is, as shown in FIG. 3, a horizontal groove 15 is formed in a predetermined portion of the partition member 13.

Figure 4:
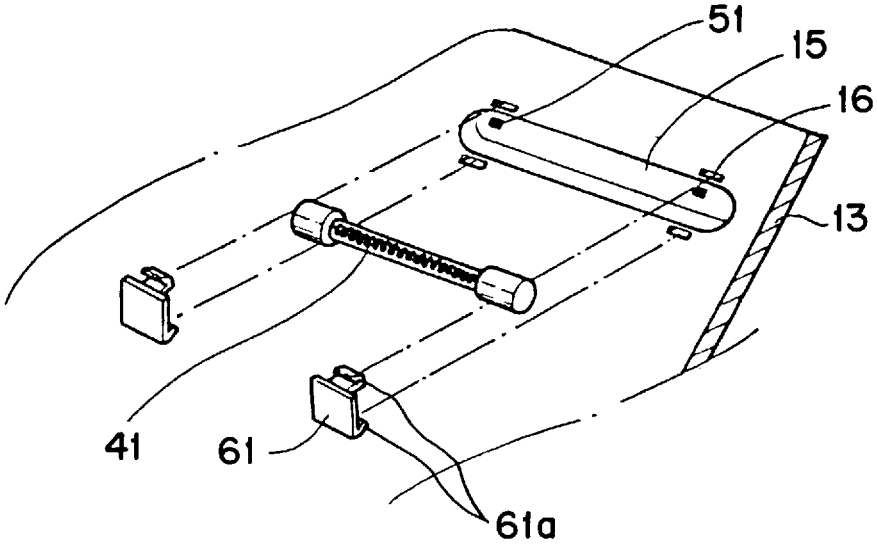
FIG. 4 is an exploded perspective view illustrating a sterilization unit of the present invention.

The ultraviolet lamp 41 is mounted inside of the groove 15. As shown in FIG. 4, at a predetermined portion of the groove 15 a pair of terminals 51 are formed to supply electric power to the lamp 41.

At both sides of the groove 15, holes 16 are formed to receive fixing means 61. That is, projections 61*a* of the fixing means 61 are inserted to the holes 16, respectively to secure the lamp 41 in place.

Figure 5:
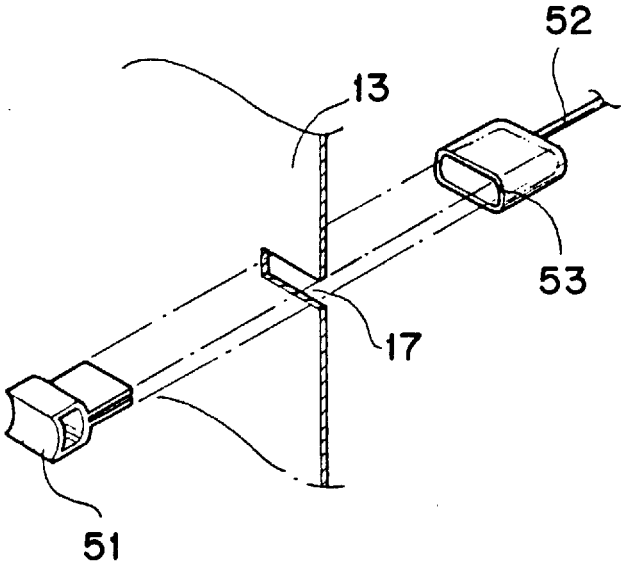
FIG. 5 is an exploded perspective view illustrating the sterilization unit of FIG. 4.
Figure 6:
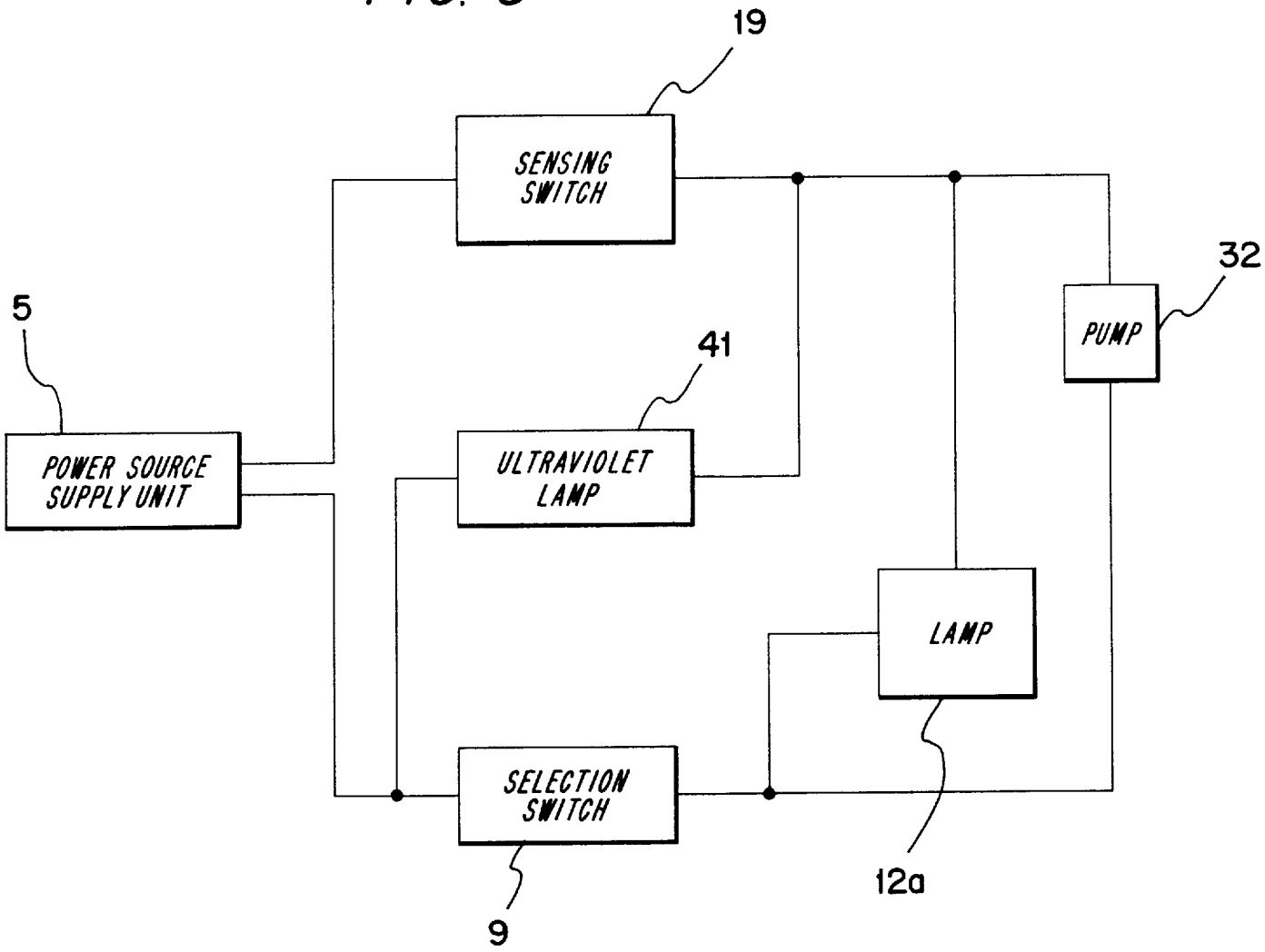
FIG. 6 is a block diagram a control system for controlling the drinking water supply apparatus of the present invention.

As shown in FIG. 5, each of the terminals 51 is connected to a wire 52 provided inside of the partition member 13. That is, a rear part of the terminal 51 can be inserted into coupling sleeve 53, which is connected to one of the wires 52, through a hole 17 formed in the partition wall 13.

An operation effect of the drinking water supply apparatus having above-mentioned structure will be described in detail.

First of all, the refrigerator is powered by electric power being supplied from a power supply unit 5.

To discharge the water from the container 20 without opening the door 12, a selection switch 9 must be pressed, for example, by a cup C moved in the direction of an arrow in FIG. 3. The pump 32 is then driven water from the container 20 to the pipes 31 through the discharge ports 21 if the selection switch 9 is continuously pressed. Therefore, the water being discharged from the container 20 is passes into the cup C through the pipe 33, the storage 35 and pipe 34 in that order.

The lamp 41 being supplied with electric power from a power source supply unit 5 emits ultraviolet rays into the container 20 at a predetermined time in order to prevent the water from being contaminated due to bacillus or foreign materials before the drinking water is discharged.

Thus, the container can store water for a long time since ultraviolet rays from the lamp are emitted into the container in order to prevent the water from being contaminated.

What is claimed is:

1. A refrigerator comprising:

a body containing a refrigerating compartment and a freezing compartment, the body including a door;

a partition wall disposed inside of the body and separating the refrigerating compartment from the freezing compartment:

a container disposed in the refrigerating compartment for storing water; a passage leading from the container to an outlet in the door for dispensing water through the door; and a sterilizer device arranged in the partition wall to be spaced from stored water in the container for emitting ultraviolet light into the container to sterilize the water stored therein.

2. The refrigerator according to claim 1, further including a sensing switch disposed inside the refrigerating compartment for sensing the presence of the container.

3. The refrigerator according to claim 1 wherein the partition wall includes a groove in which the lamp is disposed, and a pair of fixing members attachable to the partition wall for securing the lamp in place.

4. The refrigerator according to claim 3, further including two electric terminals in the groove connected to the lamp.

5. The refrigerator according to claim 4, further including a pair of sleeves connected to respective wires, the terminals being connectable to respective ones of the sleeves.

6. The refrigerator according to claim 1 wherein the container is open at its upper end, the sterilizing device overlying the upper end of the container.

7. The refrigerator according to claim 1, further including a pump disposed in the refrigerating compartment for pumping water from the container through the passage.

8. The refrigerator according to claim 1 wherein the container is removable from the refrigerating compartment along a travel path; the sterilizer device being disposed out of the path of travel of the container.

9. A refrigerator comprising:

a body forming a refrigerating compartment, the body including a door;

a container disposed in the refrigerating compartment for storing water;

a passage leading from the container to an outlet in the door for dispensing water through the door;

a sterilizer device arranged for emitting ultraviolet light into the container to sterilize water stored therein; and a sensing switch disposed inside the refrigerating compartment for sensing the presence of the container.

10. A refrigerator comprising:

a body containing a refrigerating compartment and a freezing compartment, the body including a door;

a partition wall disposed inside of the body and separating the refrigerating compartment from the freezing compartment;

a container disposed in the refrigerating compartment for storing water, the container being open at its upper end;

a passage leading from the container to an outlet in the door for dispensing water through the door; and a sterilizer device arranged in the partition wall in overlying relationship to the upper end of the container for emitting ultraviolet light into the container to sterilize water stored therein.

* * * * *